US012292190B2

(12) United States Patent
Al Khaldi et al.

(10) Patent No.: US 12,292,190 B2
(45) Date of Patent: May 6, 2025

(54) PORTABLE IGNITION SYSTEM

(71) Applicants: SAUDI ARABIAN OIL COMPANY, Dhahran (SA); ZEECO MIDDLE EAST LTD., Dammam (SA)

(72) Inventors: Muhammad M. Al Khaldi, Dammam (SA); Abdullmajeed I. Al-Sanad, Dhahran (SA); Mohd Ahmad Abugharbieh, Al-Khobar (SA)

(73) Assignees: SAUDI ARABIAN OIL COMPANY, Dhahran (SA); ZEECO MIDDLE EAST LTD., Dammam (SA)

( * ) Notice: Subject to any disclaimer, the term of this patent is extended or adjusted under 35 U.S.C. 154(b) by 455 days.

(21) Appl. No.: 18/046,399

(22) Filed: Oct. 13, 2022

(65) Prior Publication Data

US 2024/0003541 A1 Jan. 4, 2024

Related U.S. Application Data

(60) Provisional application No. 63/357,549, filed on Jun. 30, 2022.

(51) Int. Cl.

| | |
|---|---|
| ***F23G 5/40*** | (2006.01) |
| ***F23G 5/12*** | (2006.01) |
| ***F23G 5/50*** | (2006.01) |
| ***F23Q 3/00*** | (2006.01) |

(52) U.S. Cl.

CPC ..... *F23G 5/40* (2013.01); *F23G 5/12* (2013.01); *F23G 5/50* (2013.01); *F23Q 3/008* (2013.01)

(58) Field of Classification Search

CPC ..... F23G 5/12; F23G 5/40; F23G 5/50; F23Q 3/008

See application file for complete search history.

(56) References Cited

U.S. PATENT DOCUMENTS

| | | | | |
|---|---|---|---|---|
| 4,120,638 | A | 10/1978 | Straitz | |
| 6,171,098 | B1 | 1/2001 | Meyer et al. | |
| 8,390,981 | B1 | 3/2013 | Treadway et al. | |
| 2021/0388983 | A1 * | 12/2021 | Al-Amer | F23G 7/05 |

FOREIGN PATENT DOCUMENTS

| | | | |
|---|---|---|---|
| KR | 20160068568 | A | 6/2016 |
| KR | 102480847 | B1 | 12/2022 |
| RU | 2753833 | C1 | 8/2021 |

OTHER PUBLICATIONS

Office Action issued in Saudi Arabian Application No. 123447405, mailed on Aug. 28, 2024.

* cited by examiner

*Primary Examiner* — Alfred Basichas

(74) *Attorney, Agent, or Firm* — Osha Bergman Watanabe & Burton LLP

(57) ABSTRACT

A portable ignition system ignites flammable materials at a burn pit. The system includes a portable ignition system control panel with a pilot on/off indicator, a system control module, and an operator input device. The system has a fuel gas source plumbed to a pilot gas tube. The system also has an inert gas source plumbed to the pilot gas tube. The system is electrically powered by a power supply, solar panels, and/or batteries. The system has a high energy ignition system connected to the igniter and located near the pilot gas tube outlet to ignite the fuel gas. The system also has a monitored subsystem that detects parameters of operation of the portable ignition system.

22 Claims, 5 Drawing Sheets

PORTABLE IGNITION SYSTEM

BACKGROUND

Maintenance burn pits serve pipelines and other facilities. The burn pits may number in the hundreds. Most of these burn pits are located in remote locations and are used irregularly. Installing and using at each of the burn pits a fixed ignition system, which utilizes continuous pilot and pilot ignition systems, as well as pilot monitoring and purge systems, is not economically feasible. The alternative of using a fixed pilot with continuous purge on demand is also costly and might be unsafe if ignition is done manually, be it with or without a pilot line. This disclosure presents, in accordance with one or more embodiments, portable ignition systems for use at remote burn pits. The system may be utilized in several locations and transferred between them using a truck to meet the schedule of planned ignition activities.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. This disclosure presents, in accordance with one or more embodiments, methods and systems for a portable ignition system for igniting flammable materials at a burn pit. The system includes a portable ignition system control system with a control panel with a pilot on/off indicator, system control module, a start-stop switch, and a power supply. The system also has an operator input device. The system has a fuel gas source plumbed to a fuel gas valve that provides a fuel gas flow of fuel gas through a pilot guide pipe inlet of a pilot guide pipe. The pilot guide pipe also has a pilot guide pipe outlet at a pilot gas tube inlet of a pilot gas tube. The system also has an inert gas source plumbed to the pilot guide pipe inlet, an electrical energy source electrically connected to the power supply, an electrical energy storage system to store electrical energy from the electrical energy source, which is electrically connected to the power supply. The system has an igniter electrically connected to the electrical energy source located near the pilot gas tube outlet (pilot head) to ignite the fuel gas of the fuel gas flow. The system also has a monitored subsystem that detects parameters of operation of the portable ignition system.

This disclosure also presents a method for igniting flammable materials proximate a burn pit. The method includes providing a portable ignition system. The system includes a portable ignition system control system with a control panel with a pilot on/off indicator, system control module, a start-stop switch, and a power supply. The system also has an operator input device. The system has a fuel gas source plumbed to a fuel gas valve that provides a fuel gas flow of fuel gas through a pilot guide pipe inlet of a pilot guide pipe. The pilot guide pipe also has a pilot guide pipe outlet at a pilot gas tube inlet of a pilot gas tube. The system also has an inert gas source plumbed to the pilot guide pipe inlet, an electrical energy source electrically connected to the power supply, an electrical energy storage system to store electrical energy from the electrical energy source, which is electrically connected to the power supply. The system has an igniter electrically connected to the electrical energy source located near the pilot gas tube outlet to ignite the fuel gas of the fuel gas flow. The system also has a monitored subsystem that detects parameters of operation of the portable ignition system. The method includes using a monitored subsystem to detect parameters of operation of the portable ignition system. The method includes using the portable ignition system near a burn pit; and actuating the portable ignition system.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
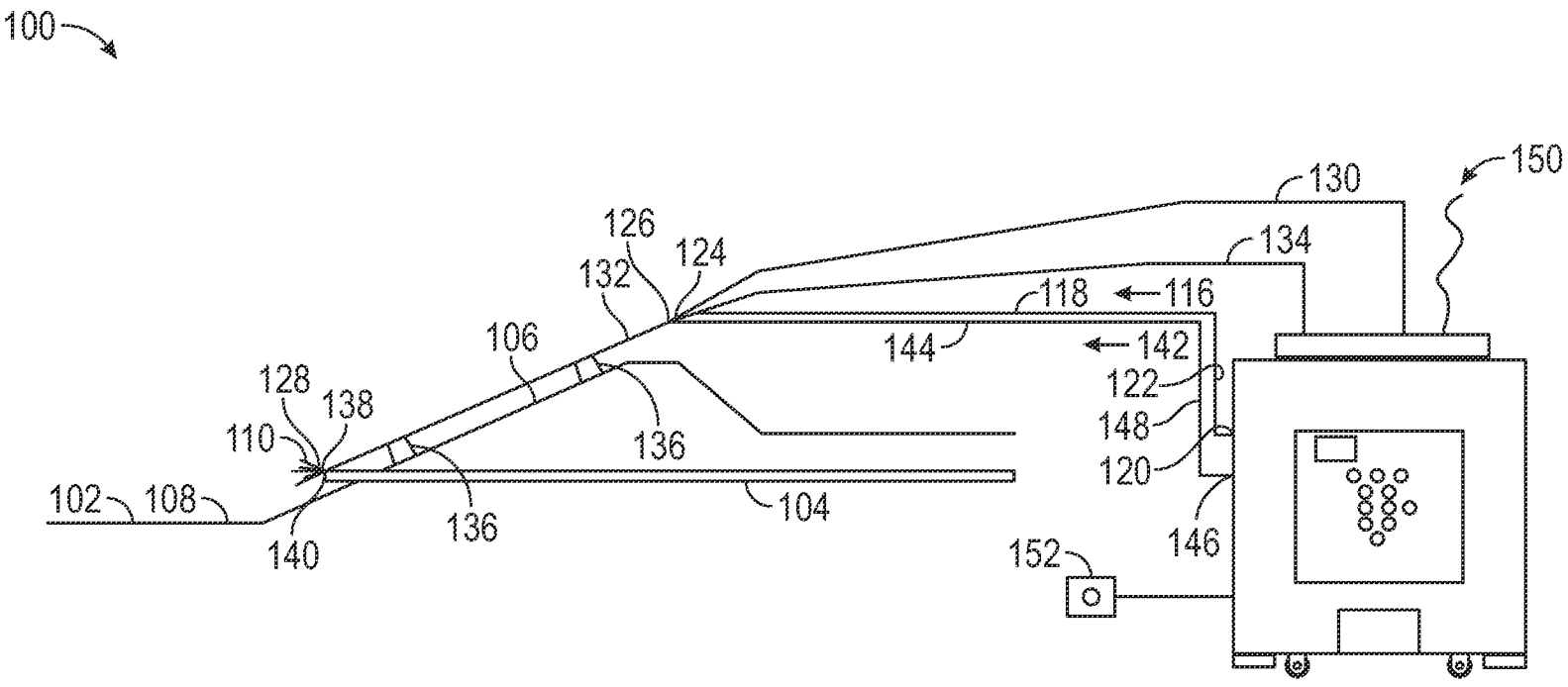
FIG. 1 shows an exemplary burn pit in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Disclosed herein is a system and method to provide economic and reduced-risk ignition of materials in pipeline maintenance burn pits. The system is used for igniting a pilot flame that in turn ignites pipeline contents such as flammable materials. The system uses a high energy ignition (HEI) igniter to generate sparks to ignite the fuel gas of the pilot flame.

The method includes providing a portable ignition system to ignite a pilot flame and monitor the pilot flame temperature. The system includes a portable ignition system control system with a control panel (a portable ignition system control panel) with a pilot on/off indicator, system control module, a start-stop switch, circuit breakers, timers, relays, solar charge controller, temperature switch, pilot failure indicator (failure lamp), pilot success indicator (proven lamp), spark generator, and a power supply. The system is designed to ignite the pilot manually or automatically. An alert that the pilot did not ignite (the failure lamp) and an affirmation that the pilot succeeded in igniting (the proven lamp) may be included with the system and may be controlled by a temperature compared to a temperature reference such as with a set point of, for example 350° F. (degrees Fahrenheit). The result of the comparison may determine an operating state of the portable ignition system. Temperature detection may be determined by a thermocouple such as a type-K thermocouple as is known in the art. The system may also have a fuel gas pressure switch and an associated actuation lockout measure for fuel gas supply from the fuel gas source. The fuel gas pressure switch may be configured to send an alarm that the fuel gas supply pressure is below a set limit, such as a pilot operation pressure drop alarm. For example, the fuel gas pressure switch may send an alarm to the control panel and illuminate an indicator to alert the operator that the propane cylinder must change. An example set point for the fuel gas pressure switch may be 4 psi (pounds per square inch). The system also has an operator input device. The system has a fuel gas source plumbed to a fuel gas valve that provides a fuel gas flow of fuel gas through a pilot gas tube inserted into, supported, and protected by a pilot guide pipe. The pilot guide pipe also has a pilot guide pipe outlet in proximity to the pipeline outlet. The pilot guide pipe guides a pilot gas tube outlet up to the edge of the pipeline outlet to ensure that the pilot is in proximity to ignite flammable materials such as gas exiting the pipeline. The pilot may be installed permanently, or the pilot may be removed during maintenance and or to insert the pilot in the other burnpits equipped with the guide pipe. The system also has an inert gas source plumbed to the pilot guide pipe inlet, an electrical energy source electrically connected to the power supply, an electrical energy storage system to store electrical energy from the electrical energy source, which is electrically connected to the power supply. The system has an igniter electrically connected to the electrical energy source. The system has the igniter located near the pilot head (the pilot gas tube outlet) to ignite the fuel gas of the fuel gas flow that is exiting the pilot tube outlet of the pilot tube. The system also has a monitored subsystem that detects parameters of operation of the portable ignition system. The method includes using the monitored subsystem to detect parameters of operation of the portable ignition system. The method includes using the portable ignition system near a burn pit; and actuating the portable ignition system.

FIG. 1 shows an example of a burn pit 102 and a pipeline 104 penetrating a berm wall 106 of burn pit 102. A portable ignition system 100 is shown in proximity to burn pit 102. In general, burn pits may be configured in a myriad of ways. Burn pit 102 is not intended to be limiting with respect to the particular configuration of pipeline 104 and the portable ignition system 100. Pipeline contents 108 of pipeline 104 exit the pipeline 104 at a point where pipeline 104 extends out beyond berm wall 106 and pipeline contents 108 enter burn pit 102. The pilot flame (hereafter, pilot 110) is located proximate a pilot gas tube outlet 128 of a pilot gas tube 126. Pilot 110 ignites pipeline contents 108 exiting the pipeline 104 and/or in burn pit 102. Portable ignition system 100 controls pilot 110 to ensure pilot 110 is ignited and remains burning during the use of portable ignition system 100. A fuel gas flow 116 of a fuel gas 118 flows out of a fuel gas source 120 through a fuel gas jumper 122 to a pilot gas tube inlet 124 of pilot gas tube 126, through pilot gas tube 126, and out of the pilot gas tube outlet 128. The fuel gas source 120 may be a fuel gas such as propane, butane, or natural gas. The fuel gas fuels the pilot 110. In accordance with one or more embodiments, fuel gas source 120 is a tank of liquid propane gas from a liquid propane cylinder with a composition consisting essentially of propane.

Pilot gas tube 126, a set of monitoring lines 134, and set of igniter lines 130 may be supported and protected by a pilot gas guide pipe 132. Monitoring lines 134 and igniter lines 130 may be supported and protected by one or more conduits separate from the pilot gas guide pipe 132. A guide support 136 may hold in place and elevate the pilot gas guide pipe 132 above the burn pit 102, pipeline 104, berm wall 106, and pipeline contents 108. Monitoring lines 134 are communicably connected to portable ignition system 100 and terminate at a temperature sensor such as a thermocouple (hereafter, thermocouple 138) arranged to monitor a temperature of pilot 110. Igniter lines 130 are communicably connected to portable ignition system 100 and terminate at an igniter 140. The igniter 140 may be a high energy ignition igniter system. When engaged, the igniter 140 may produce sparks from a spark tip of igniter 140 to ignite a mixture of fuel gas and air exiting the pilot gas tube outlet 128, known in the art as the pilot head. Sparks may be produced individually or in a repetitive sequence such as a spark interval of one spark per second, one spark per two seconds, etc. An inert gas flow 142 of an inert gas 144 flows out of an inert gas source 146 through an inert gas jumper 148 to the pilot gas tube inlet 124. The inert gas source may be an inert gas such as nitrogen, helium, argon, etc. In accordance with one or more embodiments inert gas source 146 is a tank of nitrogen gas from a nitrogen gas cylinder with a composition consisting essentially of nitrogen (N 2). The inert gas, such as nitrogen, may be used perform an inert gas purge which is to purge the pilot gas line to sweep oxygen out of the pilot gas line after installation to avoid air ingress, thus reducing the potential of an internal explosion in the pipe. The portable ignition system 100 may have an inert gas pressure switch and an associated actuation lockout measure for inert gas supply from the inert gas source. The inert gas pressure switch may be configured to send an alarm that the inert gas supply pressure is below a set limit, such as an inert gas pressure drop alarm. The monitored subsystem may include an oxygen sensor for $O_2$ measurement with an associated actuation lockout measure for $O_2$ measurement determined to be outside an $O_2$ limit range. FIG. 1 also shows portable ignition system 100 connected to a process control system 150 such as a computer system and to a remote control 152 such as a switch, a junction box, a computer terminal, etc.

Figure 2:
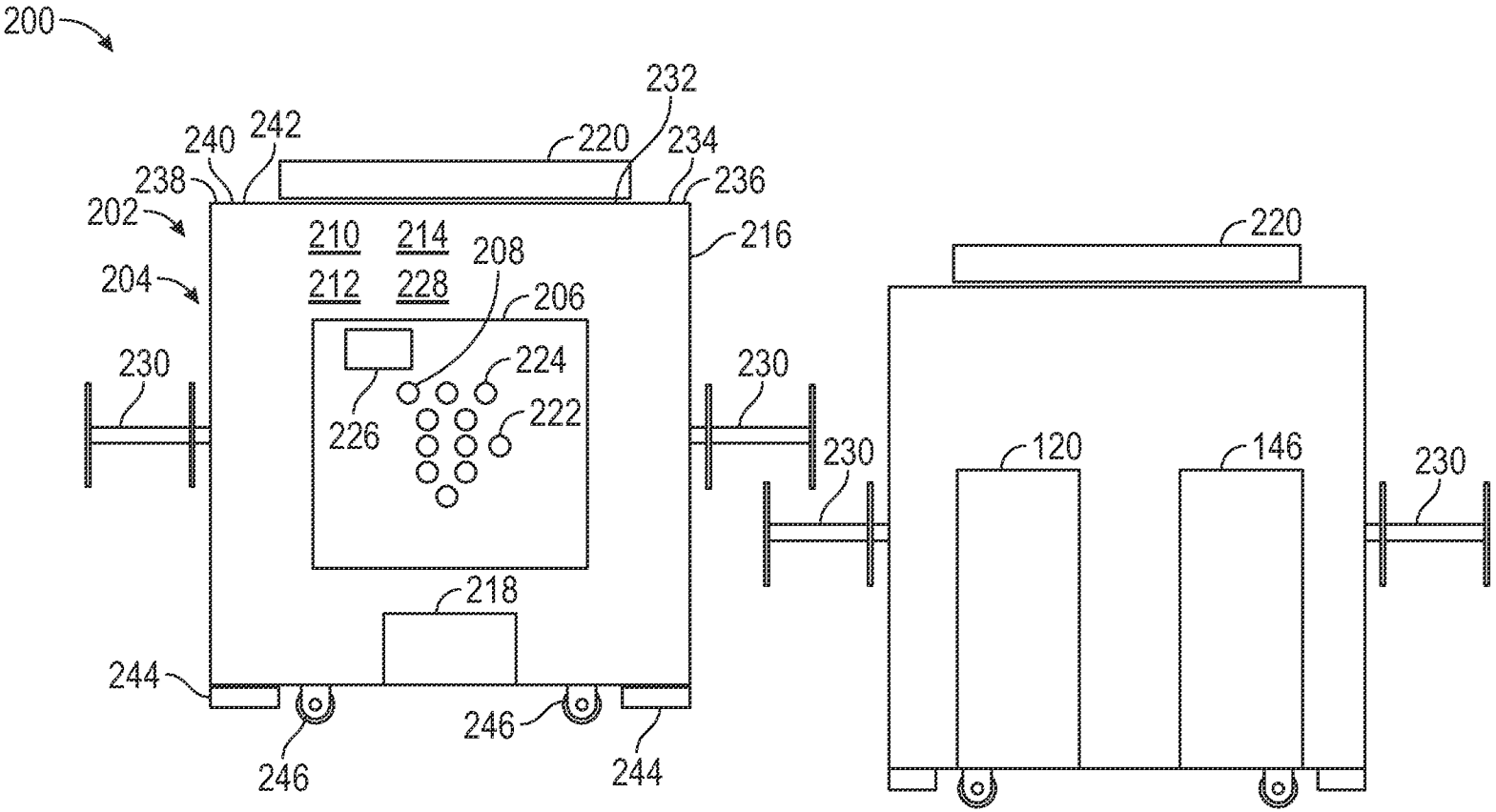
FIG. 2 shows a portable ignition system in accordance with one or more embodiments.

FIG. 2 shows, in one or more embodiments, portable ignition system 100 disposed in a portable skid such as a skid 200 and connected to pilot gas guide pipe 132. Skid 200 may also provide the structure for other components of portable ignition system 100. In accordance with one or more embodiments, portable ignition system 100 may include a portable ignition system control system such as a control system 202 and a monitored subsystem 204. Control system 202 may include a control panel 206 for use as the interface between an operator and the control system 202.

Control panel 206 may be mounted on skid 200. The control panel 206 uses an indicator 208 for indicating soon before, when, or soon after the pilot is off or on. Control panel 206 may utilize relays to perform its functions and/or it may use a controller 210 such as a system control module and/or a programmable logic controller. Controller 210 may have a computer processor 212. The control panel 206 may also have a power supply 214 for supplying power to the control system 202. The control panel 206 in combination with the monitored subsystem 204 may control the operation of portable ignition system 100 through the control system 202.

Power supply 214 may receive an input voltage of, for example, 110 or 220 VAC (volts alternating current) at 50 or 60 Hz (Hertz) of utility electrical power (utility power.) Power supply 214 may receive a utility power 216 input voltage of, for example, 12 or 24 VDC (volts direct current) of local electrical power, such as from an automobile or truck. The local electrical power may be provided by electrical battery or batteries, and/or a solar-powered electrical energy generator such as a solar photovoltaic panel or panels. Local electrical power such as by battery 218 and/or solar panel 220 may be power sources attached to, or near, skid 200 and/or the portable ignition system 100 and in electrical communication with the power supply 214. Battery 218 and/or solar panel 220 may be mounted on skid 200. The solar panel 220 may power the control panel 206 and may simultaneously charge the battery 218. Battery 218 may provide backup power during night when there is no sunshine to compensate for the solar panel 220 power output dropping to zero because the sunshine is the energy source of the solar panel. Portable ignition system 100 may include an uninterruptible power supply to provide backup power for when no other electrical source is available. Control system 202 may include a selector for the operator to use to select the power input. Control system 202 may include provision for both manual and/or automatic ignition of the pilot 110.

Remote control 152 provides a remote interface between an operator and the control panel 206. Remote control 152 may provide one, some, or all of the functionality of control system 202. Process control system 150 and/or remote control 152 may be communicatively connected to control panel 206 using wired technologies, such as electrical wire, or optical technology such as fiber optics using glass or plastic fiber, or wireless technology, such as radio control, LAN (local area network), WAN (wide area network), Bluetooth, etc.

Control panel 206 may include a power switch 222, a start and an input interface 224 used, for example to input energization instructions, pressure settings and limits, temperature settings and limits, etc. Monitored subsystem 204 may include one or more sensors (e.g., pressure transmitter, temperature sensor such as a thermocouple, etc.) configured to measure, for example, fuel gas pressure, inert gas pressure, and pilot temperature parameters of portable ignition system 100, and other parameters. Monitored subsystem 204 may include digital precision gauges and/or analog gauges such as pressure and/or temperature gauges. Digital precision gauges may provide a data logging feature to monitor and analyze pressure and temperature increments in the system and provide digital data to the controller.

Monitored subsystem 204 may include a display 226 showing all system parameters, such as pressure parameters, and including a protection system to provide limit alarm trips and one or more program interlocks. The system may include sensors such as motion detectors and surveillance cameras in proximity to areas of interest such as portable ignition system 100, burn pit 102, pipeline 104, pilot 110, and/or skid 200, etc.

The fuel gas 118 may be provided to the pilot gas tube inlet 124 through a fuel gas valve 232, such as a ½-in (inch) solenoid valve, configured to control fuel gas flow 116 of fuel gas 118 to pilot gas tube inlet 124. Fuel gas valve 232 comprises a flow path that forms part of the fuel gas flow 116, a valve opened position to allow flow along fuel gas flow 116 path, and a valve closed position to prevent flow along fuel gas flow 116 path. Fuel gas valve 232 may be manually operated and/or it may have a fuel gas valve actuator such as fuel valve actuator 234 that operates the valve without requiring human intervention by means such as electrical power, pneumatic power, or other ways. The fuel gas valve 232 with the fuel valve actuator 234 may have a fuel valve override 236 configured to manually operate the valve from the valve opened position to the valve closed position or from the valve closed position to the valve opened position. The fuel valve actuator 234 using electrical power may operate the fuel gas valve 232 using a motor, a solenoid, or other means. The fuel valve actuator 234 of the fuel gas valve 232 may be configured to receive from the controller 210 a signal to operate. The motor may operate fuel gas valve 232 directly or through a gearbox, a rack and pinion, levers, cams, and/or the like. The solenoid may operate fuel gas valve 232 directly or through a series of levers, hinges, and/or the like. The fuel gas valve 232 may operate in cooperation with a spring configured either to push or to pull such as a coil spring, wave spring, torsion spring, etc. The fuel valve actuator 234 using pneumatic power may operate the valve using compressed air, inert gas, or fuel gas, etc. acting upon an actuator diaphragm, a piston-cylinder, a plunger-cylinder, a rack-and-pinion, and/or other means. The fuel gas 118 may be provided to the pilot gas tube inlet 124 through a fuel gas regulator. The fuel gas regulator may be set manually by an operator. The fuel gas regulator may be integrated with the fuel gas valve 232.

The inert gas 144 may be provided to the pilot gas tube inlet 124 through an inert gas valve 238, such as a ½-in (inch) solenoid valve, configured to control inert gas flow 142 of inert gas 144 to pilot gas tube inlet 124. Inert gas valve 238 comprises a flow path that forms part of inert gas flow 142, a valve opened position to allow flow along inert gas flow 142 path, and a valve closed position to prevent flow along inert gas flow 142 path. Inert gas valve 238 may be manually operated and/or it may have an inert valve actuator 240 that operates the valve without requiring human intervention by means such as electrical power, pneumatic power, or other ways. The inert gas valve 238 with the inert valve actuator 240 may have an inert valve override 242 configured to manually operate the valve from the valve opened position to the valve closed position or from the valve closed position to the valve opened position. The inert valve actuator 240 using electrical power may operate the inert gas valve 238 using a motor, a solenoid, or other means. The inert valve actuator 240 of the inert gas valve 238 may be configured to receive from the controller 210 a signal to operate. The motor may operate inert gas valve 238 directly or through a gearbox, a rack and pinion, levers, cams, and/or the like. The solenoid may operate inert gas valve 238 directly or through a series of levers, hinges, and/or the like. The inert gas valve 238 may operate in cooperation with a spring configured either to push or to pull such as a coil spring, wave spring, torsion spring, etc. The inert valve actuator 240 using pneumatic power may operate the valve using compressed air, inert gas, or inert gas, etc.

acting upon an actuator diaphragm, a piston-cylinder, a plunger-cylinder, a rack-and-pinion, and/or other means. The inert gas 144 may be provided to the pilot gas tube inlet 124 through an inert gas regulator. The inert gas regulator may be set manually by an operator. The inert gas regulator may be integrated with the inert gas valve 238.

One or more computer-readable media associated with the controller 210 may also include computer-executable instructions (a program) configured to collect, store, parse, and analyze the operational data of the system. The program may be configured to perform operations consistent with embodiments of the present disclosure, for example, determine current state variables of portable ignition system 100, adjust various operating characteristics based on determined values, etc. The program may further arithmetically calculate revised state variables that seek output state goals, such as for example, mathematically seeking target values associated with variables of the system in response to feedback from a workflow in cooperation with systems and methods of the present disclosure. While portable ignition system 100 may correspond to one of pilot 110, in some embodiments, portable ignition system 100 may correspond to multiple pilots. The control system 202 may also include a computer system that is the same as or similar to that of computer 502 described below in FIG. 5 and the accompanying description. The control panel 206 may be connected to the skid 200 using a suitable means such as screws, bolts, welds, etc. and using suitable materials such as angle iron, cold-rolled steel, hot-rolled steel, aluminum, etc.

In one or more embodiments, an electrical cable harness 228 may be used to connect some or all of the electrical components of portable ignition system 100. Electrical cable harness 228 is also configured to transmit current, keep control over the system, and provide connection to the monitored subsystem. Igniter lines 130 may include electrical power and/or signal data from and/or to control system 202 to and/or from igniter 140. Monitoring lines 134 may include power and/or signal data from and/or to the temperature sensor, such as thermocouple 138, in proximity to the pilot 110 and to and/or from the control system 202. Igniter lines 130 and/or monitoring lines 134 may be stored on spools 230.

Components of portable ignition system 100 such as fuel gas jumper 122, pilot gas tube 126, igniter lines 130, monitoring lines 134, thermocouple 138, igniter 140, skid 200, control panel 206, battery 218, and solar panel 220 may comprise a material compatible with the maximum and minimum pressures and temperatures for extremes of both the climate (weather) and for the process (in service and duty cycles). Likewise, the sizes and capacities of components of portable ignition system 100 may be in a configuration compatible with extremes of the climate and of the process. Valve actuators such as fuel valve actuator 234 and inert valve actuator 240 may be specified to operate at a rate compatible with the process requirements. A maximum pressure may be such as, for example, a maximum pressure capability of fuel gas source 120 and/or inert gas source 146. A maximum temperature may be such as, for example, a maximum flame temperature of pipeline contents and/or maximum weather temperature for equipment installed in direct sunlight in an arid (desert) environment. For example, 316L may be the material used for the guide support 136, 3-inch nominal pipe may be the size for the pilot gas guide pipe 132. Skid 200 may be sized to fit on or within a mobile transport vehicle such as a truck. The skid 200 may be equipped with forklift channels 244 and/or castors 246 for ease of mobility, loading, and portability. The portable ignition system may be designed to let the operator carry it anywhere by using a forklift. The system may be a compact design that allows the operator to transport it in the back of a pick-up truck.

Figure 3:
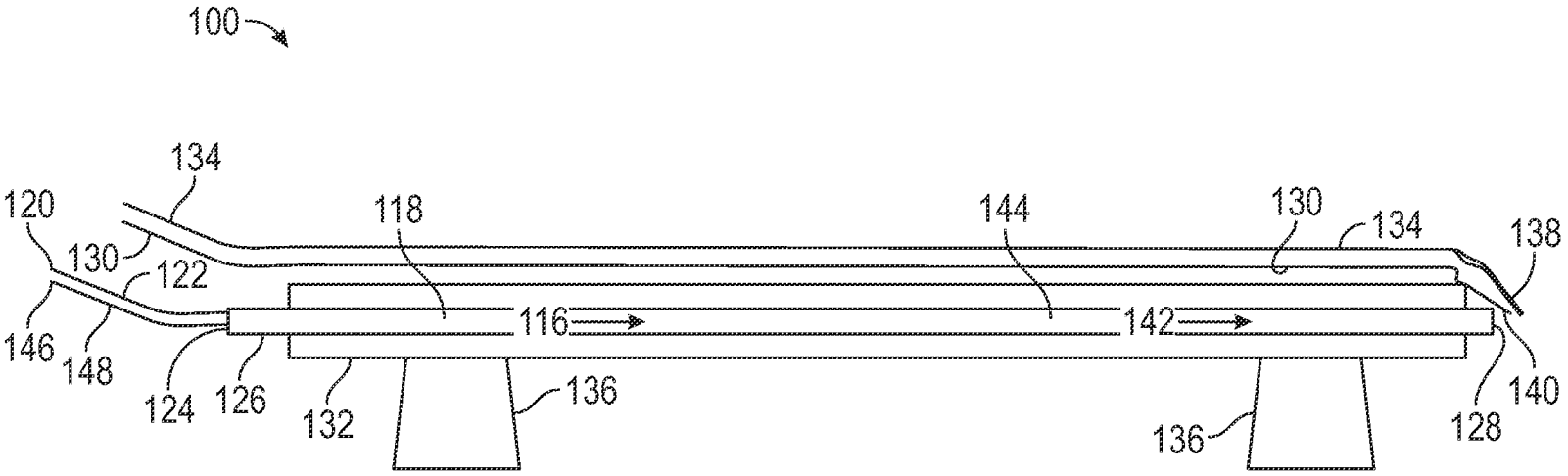
FIG. 3 shows a pilot and igniter in accordance with one or more embodiments.

FIG. 3 shows a cross section of the pilot gas guide pipe 132 with guide support 136 and with the pilot gas tube 126 inside pilot gas guide pipe 132. Also shown is a detail of thermocouple 138 and igniter 140 disposed at the pilot gas tube outlet 128. Igniter lines 130 and monitoring lines 134 are shown adjacent to pilot gas guide pipe 132. Fuel gas jumper 122 and inert gas jumper 148 are shown connected to pilot gas tube inlet 124.

Figure 4:
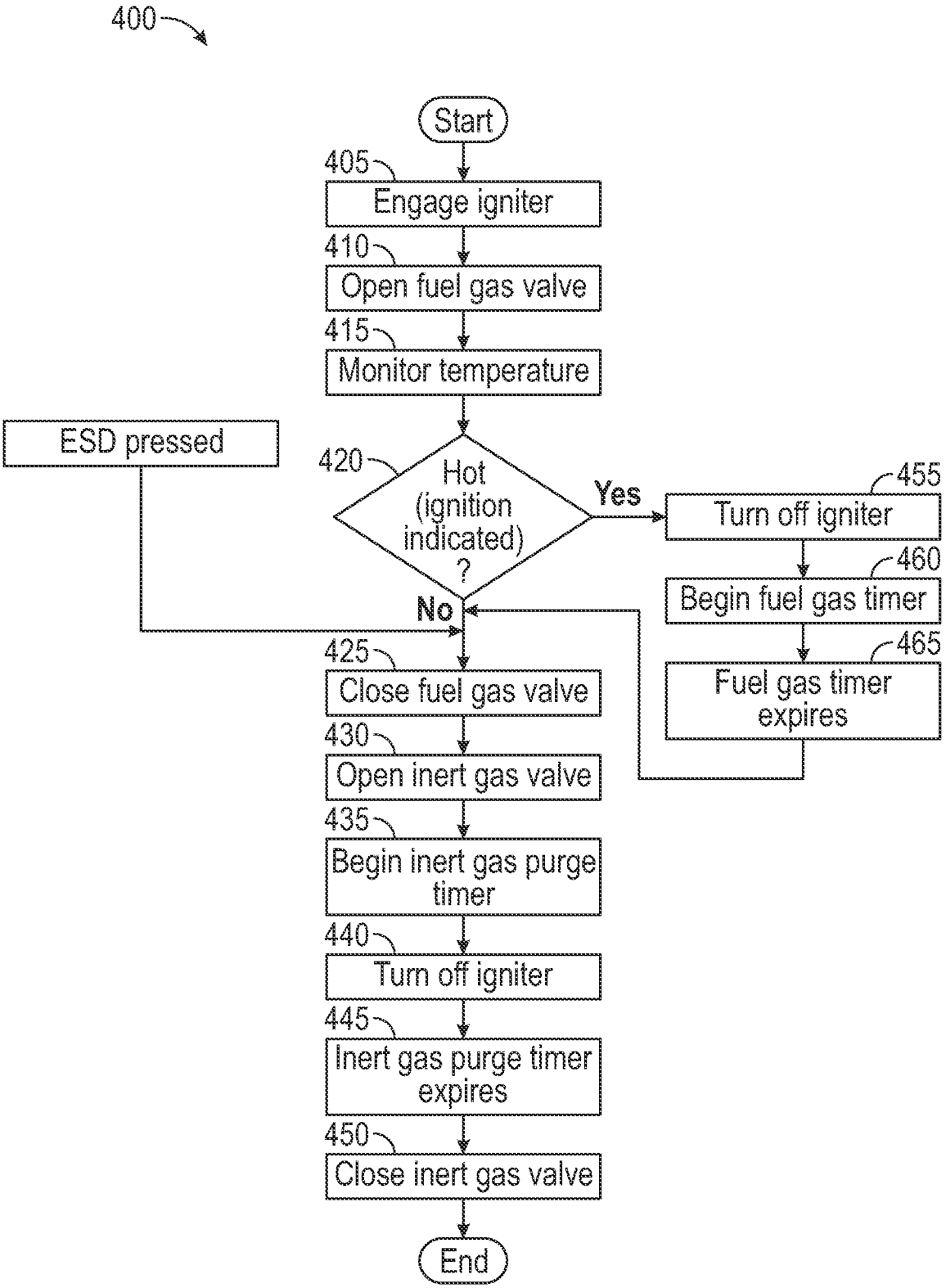
FIG. 4 shows a flowchart in accordance with one or more embodiments.

FIG. 4 shows a flowchart of a method (Block 400) for automatically and continuously controlling and monitoring a pilot 110 used for igniting pipeline contents 108 exiting the pipeline 104 and/or in burn pit 102. Further, one or more steps in FIG. 4 may be performed by one or more components as described in FIGS. 1-3 (e.g., portable ignition system 100). While the various steps in FIG. 4 are presented and described sequentially, one of ordinary skill in the art will appreciate that some or all of the steps may be executed in different orders, may be combined or omitted, and some or all of the steps may be executed in parallel. Furthermore, the steps may be performed actively or passively. Operators may launch an automated software for operating the portable ignition system 100. The operator may acknowledge various steps of the method by clicking on, in the input interface 224, text descriptions of the steps.

Referring to FIGS. 1-3 together, initially the portable ignition system 100 is disposed in proximity to burn pit 102. The portable ignition system 100 may include sensors such as motion detectors and surveillance cameras in proximity to areas of interest such as portable ignition system 100, burn pit 102, pipeline 104, pilot 110, and/or skid 200, etc. The operator may then connect the portable ignition system 100 to the pilot gas tube inlet 124, the igniter lines 130, and the monitoring lines 134. The operator may utilize one, some, or all of utility electric power, battery power, and/or solar photovoltaic power and take appropriate action(s) for each of those options, such as connecting portable ignition system 100 to the utility power 216, connecting the battery 218, and/or deploying and connecting solar panel 220. The operator may then turn on the power switch 222 that may turn on the power supply 214 to the portable ignition system 100. Before, when, or after the power is activated, the thermocouple 138 may send parameters of the thermocouple 138 to the portable ignition system 100 and may continue to send parameters until the power is turned off.

Operation may follow these steps: Purge the pipeline 104 with inert gas 144. Activate the portable ignition system 100. Pilot Failure lamp of indicator 208 may illuminate. Purge the pilot gas tube 126 with inert gas 144. Introduce the fuel gas 118 to perform a fuel gas purge of the pilot gas tube. Adjust fuel gas pressure at fuel gas valve 232. Engage igniter, manually or automatically, proximate the fuel gas flow exiting the pilot gas tube outlet. In manual operation, the operator may activate igniter switch and hold it in the activated position. In automatic operation, the operator may activate igniter switch to a position labeled "automatic." Igniter 140 may produce sparks at the spark tip at the repetitive sequence of the spark interval. In manual operation the spark interval may operate until the operator deactivates the igniter switch. In automatic operation the spark interval may operate for a duration such as a spark duration. Pilot flame ignition may heat thermocouple 138 to prove that the pilot 110 has been established, the pilot proven lamp of indicator 208 may be energized, and the pilot failure lamp of indicator 208 may be extinguished. To burn pipeline contents 108 of exiting the pipeline 104 and/or in the burn pit 102, slowly reduce inert gas 144 in pipeline 104, then slowly introduce pipeline contents 108 to pipeline 104.

Before, when, or after portable ignition system 100 is activated, the operator may start the program that performs the following steps automatically and/or the operator may perform the following steps manually. The operator may prepare a pilot flame workflow (hereafter workflow) of a list of pilot flame cycles, then select the pilot flame criteria of a first pilot flame cycle and perform at least one pilot flame cycle from the workflow. The operator may enter the data of the workflow(s) through the input interface 224 to the controller 210. The data entry through the input interface 224 may include: manually entering each value, use of a database input, through a table of data, or through a computer script. Data entry may include the steps, trips, limits, alarms, etc. of the pilot flame.

The pilot flame cycle includes igniting, monitoring, and extinguishing the pilot flame. The igniting may occur manually or may occur automatically using the controller 210 of portable ignition system 100. The parameters of each pilot flame cycle in the list of pilot flame cycles may include modifying the characteristic of temperature through a series of steps such as fuel gas flow 116 rate, igniter 140 engagement, data logging instructions, etc. Data logging instructions may include, for example, recording the temperature at given time intervals, recording duration of temperature differential target achievement, etc. Program interlock parameters may include ensuring igniter 140 engagement prior to fuel gas flow commencement. The program may prevent the operation of portable ignition system 100 by preventing opening of fuel gas valve 232 if the igniter is not energized.

Programmable limit alarm trips may include providing audible and visual alarms or taking other actions such as closing fuel gas valve 232. Alarms and actions may be activated for conditions such as if a maximum temperature differential limit is met or exceeded, if a minimum temperature differential limit is not met or exceeded, if a maximum temperature differential target is not achieved before a duration is met or exceeded, if a temperature upper limit is met or exceeded, etc. The adjustable temperature set points may include a set of temperatures for each of the pilot flame cycles such as a first temperature ($\text{temperature}_1$), a second temperature ($\text{temperature}_2$), through an $n^{th}$ temperature ($\text{temperature}_n$). An example temperature upper limit is 3600° F./2000° C. (degrees Fahrenheit, degrees centigrade.) Examples of actions that may be taken include terminating the pilot flame cycle and disengaging the igniter 140, thus stopping the igniter from producing sparks.

After confirming and completing the data entry, the operator may start the pilot flame cycle. The operator or the software may purge the pilot gas line with inert gas to sweep oxygen out. The software may continuously monitor the temperature, the fuel gas source 120 pressure, the inert gas source 146 pressure, and movements around the portable ignition system 100 and/or the burn pit 102. Actuation of the portable ignition system may include integrating, using the computer processor, the values of the operational parameters from the monitored subsystem as readiness states of the system. Continuous monitoring of the operational parameters may provide values that may be compared, using the computer processor, with reference values, such as a temperature reference, to determine an operating state of the portable ignition system. The response to the result of the comparing may be to control the portable ignition system. Actuation may also include obtaining at least one signal from the monitored subsystem. In case temperature reaches the temperature differential setting (TD1) during the set duration (T1), the software may activate a message (GREEN) that the portable ignition system 100 reached required target temperature or temperature differential (hereafter target) and the pilot flame hold time is triggered. Likewise, in case temperature reaches the target setting (TD2) during the set duration (T2), the software may activate a message (GREEN) that the portable ignition system 100 reached required target and the pilot flame hold time is triggered. In case temperature reaches the target setting (TDn) during the set duration (Tn), the software may activate a message (GREEN) that the portable ignition system 100 reached required target and the pilot flame hold time is triggered.

Once workflow is completed, the software may activate a message (GREEN) that the portable ignition system 100 has completed its role successfully, and the software may save the operating parameters, data records, and data trends for future records and printing. Once the workflow is completed, the software may activate the purge mechanism to perform an inert gas flow purge. The purge mechanism may be the inert valve actuator 240 opening inert gas valve 238 to commence inert gas flow 142, and the fuel valve actuator 234 closing the fuel gas valve 232 to terminate the fuel gas flow 116. The software may activate an inert gas flow purge timer in coordination with the purge mechanism, such as beginning the inert gas flow purge timer before, when, or after the inert gas purge begins. The purge timer may operate the purge mechanism for a duration, then deactivate the purge mechanism in relation to the inert gas flow purge timer. The inert gas valve may close before, when, or after expiration of the inert gas flow purge timer. The software monitors parameters such as the temperatures and pressures, and before, when, or after the parameters meet targets, the software may activate an instruction to the operators to confirm no pilot flame remains ignited. Operators shall visually check no pilot flame is ignited and then end by stopping the portable ignition system 100.

In case of the acceptance criteria not being met, such as by a temperature exceeding a limit during any of the time slots (T1, T2 and Tn), audible and visual alarms are triggered, a warning alarm (YELLOW) is activated, and the portable ignition system 100 may be stopped. In case of temperature not increasing for a period of time, the system may generate audio visual alarms, and warning alarm (YELLOW) is activated indicating that there is a problem in the system, and the portable ignition system 100 may be stopped. In case the pressure in the system, such as fuel gas source 120 or inert gas source 146, exceeds the limits, the software may activate an emergency alarm (RED) and the portable ignition system 100 may be stopped.

In case motion detection sensors (surveillance camera) detect movements around the portable ignition system 100, the system may generate audio visual alarms and a warning alarm (YELLOW) may be activated. If this alarm is not cleared within a set period of time such as one minute, the software may activate an emergency alarm (RED) and the portable ignition system 100 may be stopped.

If at any time during the operation of the portable ignition system 100 an emergency shut down (ESD) command is received, then before, when, or after receipt of a shut down actuation, the portable ignition system 100 may be stopped. The ESD command may come from a physical button, such as a push button operator, or a switch on or near the portable ignition system 100, it may be sent by remote control 152, or the ESD may come from other means.

The portable ignition system 100 begins generating pilot 110 by purging pilot gas tube 126 with inert gas 144, then engaging the igniter 140 by sending power and/or signal along the igniter lines 130 to the igniter 140. Pilot Failure lamp of indicator 208 may illuminate (Block 405). Portable ignition system 100 may start a spark duration timer such as a five-minute duration timer. The spark duration timer may prolong the life of the spark tip of the igniter 140 by limiting the duration of time that sparks are produced from the spark tip. For example, sparks may be produced individually or in a repetitive sequence such as one spark per second, one spark per two seconds, etc. for the spark duration of, for example, five minutes. Portable ignition system 100 may then open fuel gas valve 232 by manually opening it or by using the fuel valve actuator 234. If the fuel gas valve 232 is equipped with the fuel valve actuator 234 and the fuel valve actuator 234 is actuated, but fails to open the fuel gas valve 232, then the operator may use the fuel valve override 236 to manually open the valve. Fuel gas flow 116 may commence when fuel gas valve 232 is in the open condition. (Block 410). In the condition with the igniter 140 engaged, fuel gas flow 116 established, then the pilot 110 may ignite. Before, when, or soon after pilot 110 ignites, thermocouple 138 may start to monitor a temperature change at pilot 110. (Block 415).

The controller 210 and/or the operator may check for pilot temperature compliance with a temperature acceptance criterion. (Block 420). A temperature acceptance criterion may be, for example, a temperature at the thermocouple 138 that is a target temperature differential referenced to the starting non-ignited temperature, and/or a temperature differential referenced to ambient temperature. The temperature acceptance criterion may include a time duration factor such as a temperature differential over a target period of time. The target differential temperatures may include limits such as a maximum or minimum differential and/or a minimum or maximum duration to reach the target temperature differential.

For the controller 210 to check for compliance, the computer processor 212 of the controller 210 monitors at least one operational parameter of the pilot 110, such as temperature, using the monitored subsystem 204. Computer processor 212 collects a set of data of the operational parameter(s), such as temperature and time, and determines characteristics of the operational parameter(s) such as rate of change of temperature over time. Controller 210 may store at least one result of the comparing in an operational record and/or insert a new record in the operational record indicating the temperature results in accordance with the pilot flame temperature acceptance criterion. Computer processor 212 compares the set of data of the operational parameter(s) with the acceptance criterion. (Block 420).

The computer processor 212 then controls the system in response to the comparing. If the temperature criterion is not met (Block 420:no), then the controller 210 may take a further action such as proceeding to a shut down sequence (Block 425), operating the valve(s) such as shutting the fuel gas valve 232 (Block 425), opening the inert gas valve 238 (Block 430), starting an inert gas flow timer (Block 435), disengaging the igniter 140 (Block 440), then before, when, or after the inert gas flow timer expires (Block 445), closing the inert gas valve 238 (Block 450). The controller 210 may also send an alarm, alert the operator, and/or end the pilot flame cycle and/or the workflow.

If the temperature criterion is met (Block:420:yes), then the controller turns off the igniter. Pilot Proven lamp of indicator 208 may illuminate and Pilot Failure lamp may extinguish (Block 455). Portable ignition system 100 may begin a fuel gas flow 116 timer (Block 460) of a pilot flame duration, and then monitor the operational parameters until the pilot flame duration timer expires (Block 465). Before, when, or after the pilot flame duration timer expires, the method proceeds by comparing the pilot flame cycle, with the successive pilot flame cycle$_{n-1}$ or "next pilot flame cycle" of the pilot flame cycles in the workflow. If there is a next pilot flame cycle, then the method selects the pilot flame cycle criteria of the next pilot flame cycle from the workflow and proceeds to perform the pilot flame cycle using the successive pilot flame cycle parameters. If there is no next pilot flame cycle, then the method proceeds to the shutdown sequence (Block 425). If the pilot flame is extinguished, then the controller 210 may attempt a reignition cycle. The reignition cycle may include restarting igniter 140 to generate sparks. The reignition cycle may repeat a predetermined quantity such as once, twice, etc. to $n_{max}$ reignitions. Reignition cycles may continue before, when, or after the $n_{max}$ reignition quantity is met. The operator may perform reignitions in manual mode under conditions such as pilot 110 temperature below set point.

Figure 5:
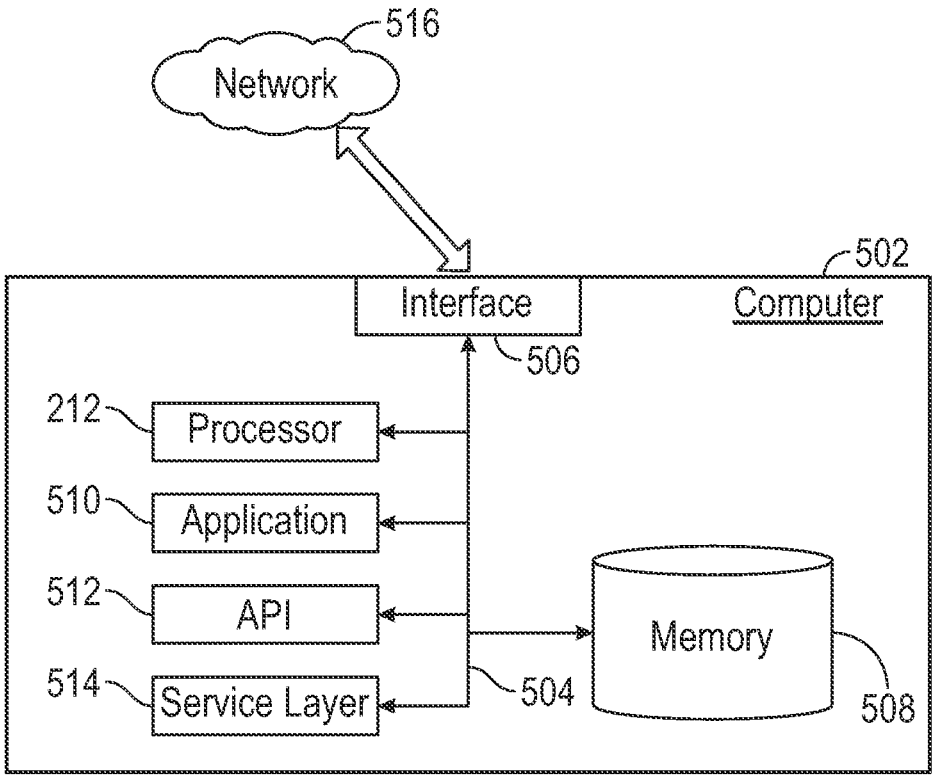
FIG. 5 shows a computing system in accordance with one or more embodiments.

FIG. 5 is a Block diagram of a computer 502 used to provide computational functionalities associated with described algorithms, methods, functions, processes, flows, and procedures as described in the instant disclosure, according to an implementation. The computer 502 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 502 may include a computer that includes an input device, such as a keypad, keyboard, touch screen, or other device that can accept user information, and an output device that conveys information associated with the operation of the computer 502, including digital data, visual, or audio information (or a combination of information), or a graphical user interface (GUI.)

The computer 502 can serve in a role as a client, a network component, a server, a database or other persistency, or any other component (or a combination of roles) of a computer for performing the subject matter described in the instant disclosure. The computer 502 is communicably coupled with a network 516. In some implementations, one or more components of the computer 502 may be configured to operate within environments, including cloud-computing-based, local, global, or other environment (or a combination of environments).

At a high level, the computer 502 is an electronic computing device operable to receive, transmit, process, store, or manage data and information associated with the described subject matter. According to some implementations, the computer 502 may also include or be communicably coupled with an application server, e-mail server, web server, caching server, streaming data server, business intelligence (BI) server, or other server (or a combination of servers).

The computer 502 can receive requests over network 516 from a client application (for example, executing on another computer 502) and responding to the received requests by processing the said requests in an appropriate software application. In addition, requests may also be sent to the computer 502 from internal users (for example, from a command console or by other appropriate access method), external or third-parties, other automated applications, as well as any other appropriate entities, individuals, systems, or computers.

Each of the components of the computer 502 can communicate using a system bus 504. In some implementations, any or all of the components of the computer 502, both hardware or software (or a combination of hardware and software), may interface with each other or the interface 506 (or a combination of both) over the system bus 504 using an application programming interface (API) (hereafter, API 512) or a service layer 514 (or a combination of the API 512 and service layer 514. The API 512 may include specifications for routines, data structures, and object classes. The API 512 may be either computer-language independent or dependent and refer to a complete interface, a single function, or even a set of APIs. The service layer 514 provides software services to the computer 502 or other components (whether or not illustrated) that are communicably coupled to the computer 502.

The functionality of the computer 502 may be accessible for all service consumers using this service layer. Software services, such as those provided by the service layer 514, provide reusable, defined business functionalities through a defined interface. For example, the interface may be software written in JAVA, C++, or other suitable language providing data in extensible markup language (XML) format or another suitable format. While illustrated as an integrated component of the computer 502, alternative implementations may illustrate the API 512 or the service layer 514 as stand-alone components in relation to other components of the computer 502 or other components (whether or not illustrated) that are communicably coupled to the computer 502. Moreover, any or all parts of the API 512 or the service layer 514 may be implemented as child or sub-modules of another software module, enterprise application, or hardware module without departing from the scope of this disclosure.

The computer 502 includes an interface 506. Although illustrated as a single one of interface 506 in FIG. 5, two or more of interface 506 may be used according to particular desires or implementations of the computer 502. The interface 506 is used by the computer 502 for communicating with other systems in a distributed environment that are connected to the network 516. Generally, the interface 506 includes logic encoded in software or hardware (or a combination of software and hardware) and operable to communicate with the network 516. More specifically, the interface 506 may include software supporting one or more communication protocols associated with communications such that the network 516 or interface's hardware is operable to communicate physical signals within and outside of computer 502.

The computer 502 includes at least one of computer processor 212. Although illustrated as a single one of computer processor 212 in FIG. 5, two or more processors may be used according to particular desires or particular implementations of the computer 502. Generally, the computer processor 212 executes instructions and manipulates data to perform the operations of the computer 502 and any algorithms, methods, functions, processes, flows, and procedures as described in the instant disclosure.

The computer 502 also includes a memory 508 that holds data for the computer 502 or other components (or a combination of both) that can be connected to the network 516. For example, memory 508 may include a database storing data and/or processing instructions consistent with this disclosure. According to further embodiments, memory may correspond, for example, to memory 508 where a computer 502 has been implemented as a controller for system (100). Although illustrated as a single one of memory 508 in FIG. 5, two or more memories may be used according to particular desires and/or implementations of the computer 502 and the described functionality. While memory 508 is illustrated as an integral component of the computer 502, in alternative implementations, memory 508 can be external to the computer 502.

The application 510 is an algorithmic software engine providing functionality according to particular desires and/or particular implementations of the computer 502, particularly with respect to functionality described in this disclosure. For example, application 510 can serve as one or more components, modules, applications, etc. Further, although illustrated as a single one of application 510, the application 510 may be implemented as more than one of application 510 on the computer 502. In addition, although illustrated as integral to the computer 502, in alternative implementations, the application 510 can be external to the computer 502.

There may be any number of the computer 502 associated with, or external to, a computer system containing computer 502, each computer 502 communicating over network 516. Further, the term "client," "user," and other appropriate terminology may be used interchangeably as appropriate without departing from the scope of this disclosure. Moreover, this disclosure contemplates that many users may use one of computer 502, or that one user may use more than one of computer 502.

While a number of illustrative embodiments have been described in detail above, those skilled in the art will readily appreciate that many modifications are possible in the example embodiments without materially departing from the scope of the present disclosure.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as illustrative only, with a true scope of the disclosure being indicated by the following claims.

What is claimed is:

1. A portable ignition system for igniting flammable materials at a burn pit, the system comprising:

a portable ignition system control panel comprising:

a pilot on/off indicator;

a system control module;

a start-stop switch;

a power supply;

an input device;

a fuel gas source plumbed to a fuel gas valve arranged to provide a fuel gas flow of fuel gas through a pilot guide pipe inlet of a pilot guide pipe;

wherein the pilot guide pipe further comprises a pilot guide pipe outlet disposed at:

a pilot gas tube inlet of a pilot gas tube;

an inert gas source plumbed to the pilot guide pipe inlet;

an electrical energy source electrically connected to the power supply;

an electrical energy storage system configured to store electrical energy from the electrical energy source and electrically connected to the power supply;

an igniter electrically connected to the electrical energy source and disposed proximate to a pilot gas tube outlet of the pilot gas tube and arranged to ignite the fuel gas of the fuel gas flow; and a monitored subsystem configured to detect parameters of operation of the portable ignition system.

2. The portable ignition system of claim 1, wherein:

the fuel gas source comprises a liquid propane cylinder comprising a composition consisting essentially of propane.

3. The portable ignition system of claim 1, wherein:

the inert gas source comprises a nitrogen gas cylinder comprising a composition consisting essentially of N2.

4. The portable ignition system of claim 1, wherein:

the electrical energy source comprises a solar-powered electrical energy generator; and the electrical energy storage system comprises at least one battery.

5. The portable ignition system of claim 1, wherein:

the igniter comprises a high energy ignition igniter system.

6. The portable ignition system of claim 1, further comprising:

at least one thermocouple disposed proximate the pilot gas tube outlet and arranged to detect a temperature parameter of the fuel gas of the fuel gas flow and to provide the temperature parameter to the monitored subsystem.

7. The portable ignition system of claim 1, wherein:

the fuel gas valve comprises a fuel gas valve actuator arranged to operate the fuel gas valve; and the fuel gas valve actuator is communicably coupled to the control panel to activate the fuel gas valve actuator.

8. The portable ignition system of claim 1, wherein:

the parameters of the operation include:

pilot operation;

pressure drop alarm for drop in pressure in the fuel gas source;

pressure drop alarm for drop in pressure in the inert gas source;

actuation lockout measure for fuel gas source;

actuation lockout measure for inert gas source; and actuation lockout for $O_2$ measurement.

9. The portable ignition system of claim 1, wherein:

the portable ignition system is disposed on a portable skid; and the portable skid is configured to fit onto a mobile transport.

10. A method for igniting flammable materials proximate a burn pit, the method comprising:

providing a portable ignition system comprising:

a portable ignition system control panel comprising:

a pilot on/off indicator;

a system control module;

a start-stop switch;

a power supply;

a fuel gas source plumbed to a fuel gas valve arranged to provide a fuel gas flow of fuel gas through a pilot guide pipe inlet of a pilot guide pipe;

wherein the pilot guide pipe further comprises a pilot guide pipe outlet disposed at a pilot gas tube inlet of a pilot gas tube;

an inert gas source plumbed to the pilot guide pipe inlet;

an electrical energy source electrically connected to the power supply;

an electrical energy storage system configured to store electrical energy from the electrical energy source and electrically connected to the power supply;

an igniter electrically connected to the electrical energy source and disposed proximate to a pilot gas tube outlet of the pilot gas tube and arranged to ignite the fuel gas of the fuel gas flow;

a monitored subsystem configured to detect parameters of operation of the portable ignition system;

disposing the portable ignition system proximate a burn pit; and actuating the portable ignition system.

11. The method of claim 10, wherein the actuating the portable ignition system comprises signaling the portable ignition system to actuate;

opening the fuel gas valve to start the fuel gas flow exiting the pilot gas tube outlet to perform a fuel gas purge; and energizing an igniter proximate the fuel gas flow exiting the pilot gas tube outlet.

12. The method of claim 11, wherein the portable ignition system further comprises a portable ignition system control system.

13. The method of claim 12, wherein the portable ignition system control system is disposed proximate the burn pit.

14. The method of claim 12, wherein the portable ignition system control system is connected to a process control system; and/or wherein the portable ignition system control system is connected to a remote control comprising an emergency shut down.

15. The method of claim 14, wherein the signaling the portable ignition system to operate is sent by the portable ignition system control system via:

the process control system; and/or the remote control.

16. The method of claim 10, wherein the portable ignition system further comprises a monitored subsystem.

17. The method of claim 16, wherein the actuating the portable ignition system further comprises integrating, using a computer processor, readiness states from the monitored subsystem.

18. The method of claim 17, wherein the actuating the portable ignition system further comprises obtaining at least one signal from the monitored subsystem.

19. The method of claim 17, wherein the actuating the portable ignition system further comprises determining, using the computer processor, to actuate the portable ignition system.

20. The method of claim 17, wherein the monitored subsystem comprises a monitoring of a temperature of the fuel gas flow exiting the pilot tube.

21. The method of claim 20, wherein the monitoring of the temperature is compared, using the computer processor, with a temperature reference to determine an operating state of the portable ignition system and controlling the portable ignition system in response to the comparing.

22. The method of claim 10, wherein the fuel gas valve closes to stop the fuel gas flow upon receipt of a shut down actuation;

an inert gas valve opens to start an inert gas flow to begin an inert gas purge;

an inert gas flow purge timer begins before, when, or after the inert gas purge begins; and the inert gas valve closes before, when, or after expiration of the inert gas flow purge timer.

* * * * *